US009700482B2

(12) United States Patent
Walker

(10) Patent No.: US 9,700,482 B2
(45) Date of Patent: Jul. 11, 2017

(54) MECHANICAL CHEST COMPRESSION DEVICE WITH TILT SENSOR

(71) Applicant: Physio-Control, Inc., Redmond, WA (US)

(72) Inventor: Robert G. Walker, Seattle, WA (US)

(73) Assignee: Physio-Control, Inc., Redmond, WA (US)

( * ) Notice: Subject to any disclaimer, the term of this patent is extended or adjusted under 35 U.S.C. 154(b) by 746 days.

(21) Appl. No.: 13/951,356

(22) Filed: Jul. 25, 2013

(65) Prior Publication Data

US 2014/0046228 A1 Feb. 13, 2014

Related U.S. Application Data

(60) Provisional application No. 61/682,158, filed on Aug. 10, 2012.

(51) Int. Cl.
*A61H 31/00* (2006.01)

(52) U.S. Cl.
CPC ..... *A61H 31/006* (2013.01); *A61H 31/005* (2013.01); *A61H 31/008* (2013.01); *A61H 2201/0184* (2013.01); *A61H 2201/5069* (2013.01); *A61H 2201/5097* (2013.01)

(58) Field of Classification Search
CPC .... A61H 31/00; A61H 31/004; A61H 31/005; A61H 31/006; A61H 31/007; A61H 31/008; A61H 2031/001; A61H 2031/002; A61H 2031/003; A61H 2031/025
See application file for complete search history.

(56) References Cited

U.S. PATENT DOCUMENTS

| | | | | |
|---|---|---|---|---|
| 4,082,090 | A * | 4/1978 | Harrigan | A61H 31/00 601/41 |
| 6,174,295 | B1 * | 1/2001 | Cantrell | A61H 31/00 601/41 |
| 2002/0055694 | A1 * | 5/2002 | Halperin | A61B 5/04017 601/41 |
| 2008/0097257 | A1 * | 4/2008 | Stromsnes | A61H 31/00 601/41 |
| 2010/0198118 | A1 * | 8/2010 | Itnati | A61H 31/004 601/41 |
| 2010/0228166 | A1 * | 9/2010 | Centen | A61H 31/004 601/41 |
| 2011/0040217 | A1 * | 2/2011 | Centen | A61B 5/0064 601/41 |
| 2012/0191014 | A1 * | 7/2012 | Fossan | A61H 31/005 600/587 |
| 2013/0060173 | A1 | 3/2013 | Palazzolo et al. | |
| 2013/0102936 | A1 * | 4/2013 | Halsne | A61H 31/005 601/41 |

* cited by examiner

*Primary Examiner* — Valerie L Woodward
(74) *Attorney, Agent, or Firm* — Lane Powell PC

(57) ABSTRACT

A medical device such as an external cardiopulmonary resuscitation (CPR) device delivers chest compressions to a patient. The patient may shift and/or slide within the CPR chest compression structure if the CPR chest compression structure is tilted from the horizontal, however. A tilt module is used to sense a tilt event, report it to a user of the CPR chest compression machine, and cause the CPR chest compression machine, user, or tilt module to respond to the tilt event. Response can be pausing the CPR chest compression machine, having the user reposition the CPR chest compression machine, or the like.

46 Claims, 5 Drawing Sheets

ALTERNATIVE COMPRESSION STRUCTURE OF CPR CHEST COMPRESSION MACHINE

COMPRESSION STRUCTURE OF CPR CHEST COMPRESSION MACHINE

ALTERNATIVE COMPRESSION STRUCTURE OF CPR CHEST COMPRESSION MACHINE

22º TILTED COMPRESSION STRUCTURE OF CPR CHEST COMPRESSION MACHINE

45º TILTED COMPRESSION STRUCTURE OF CPR CHEST COMPRESSION MACHINE

METHODS

MECHANICAL CHEST COMPRESSION DEVICE WITH TILT SENSOR

RELATED APPLICATION

This application is related to and claims the benefit of priority of U.S. Provisional Patent Application Ser. No. 61/682,158, filed on Aug. 10, 2012, the disclosure of which is incorporated by reference herein.

BACKGROUND

In certain types of medical emergencies, Cardiopulmonary Resuscitation (CPR) needs to be delivered to a patient. CPR includes repeatedly compressing the chest of the patient, to cause their blood to circulate some. CPR also includes delivering rescue breaths to the patient. A number of people are trained in CPR, just in case, even though they are not trained in the medical professions.

The chest compressions are intended to prevent damage to organs like the brain. In some instances, the chest compressions merely maintain the patient, until a more definite therapy is made available, such as defibrillation. Defibrillation is an electrical shock deliberately delivered to a person, in the hope of correcting their heart rhythm.

A problem is that CPR is sometimes ineffective for preventing damage to the patient. That can happen whether or not the rescuer who performs the CPR is part of the medical profession. The most frequent example of such ineffectiveness is compressions that are not deep enough, or not frequent enough. Even the best trained rescuers can become fatigued after delivering CPR, with the compressions deteriorating in quality. And that is without even accounting for the emotions of the moment, which might impact a lay rescuer.

The risk of ineffective chest compressions has been addressed in part by defibrillator manufacturers. Some defibrillators nowadays issue verbal and visual prompts and other instructions as to how CPR is to be performed. These are often according to the guidelines of medical experts, such as the American Heart Association. These prompts and other instructions and can help the rescuer focus better, even if the latter cannot remember their training.

The risk of ineffective chest compressions has been additionally addressed with CPR feedback devices. These devices actually detect the depth and frequency of compressions that the rescuer is performing, and give feedback to the rescuer that specifically attuned to what the rescuer is doing. This feedback can be in accordance with how well the rescuer is meeting the above mentioned guidelines, especially in achieving the indicated depth of compressions.

Reaching the appropriate depth is difficult. The recommended depth is a range. If the actual depth is less than the range, not enough blood is moved within the patient. If the depth exceeds the range, the patient's ribs may break. And, even for experienced rescuers, it is sometimes hard to discern the appropriate depth. Reaching the appropriate depth is even more difficult if the patient is on a flexible mattress that partly recedes, as the rescuer is pushing from the top. And CPR compressions are even harder in the first place, if the rescuer has to deliver them in a moving ambulance.

The risk of ineffective chest compressions has been moreover addressed with CPR chest compression machines. Such machines have been known by a number of names, such as mechanical CPR devices, cardiac compressors, external chest compression machines, and so on.

CPR chest compression machines repeatedly compress and release the chest of the patient. Such machines can be programmed so that they will compress and release at the recommended rate, and always reach a specific depth within the recommended range.

A problem with CPR chest compression machines is that the person may shift and/or slide within the CPR chest compression structure if the CPR chest compression structure is tilted from the horizontal. This may happen even if the person is harnessed in the CPR chest compression machine.

Shifting and sliding can be caused by the patient and/or compression structure being moved up or down stairs, for example. If the person slides in the CPR chest compression machine, then the piston, or equivalent chest compressing component, of the CPR chest compression structure will not make contact with the person at the proper location on the person's chest. It is sometimes advised to not operate, or operate with caution, the CPR chest compression machine, during periods of time when the person and/or CPR chest compression structure are tilted more than a critical value. Such limitations may be difficult to remember, or may be disregarded, during actual resuscitation use of the CPR chest compression machine, to the possible detriment of the effectiveness of the chest compressions being provided.

BRIEF SUMMARY

The present description gives instances of medical devices, processors, and methods, the use of which may help overcome problems and limitations of the prior art.

In one embodiment, a medical device facilitates delivery of cardiopulmonary resuscitation (CPR) to a patient. The medical device includes an external chest compressor that is configured to deliver CPR compressions to a chest of the patient and a tilt module. The tilt module is configured to sense a tilt event of the external chest compressor device and cause the external chest compressor and/or tilt module to respond to the sensed tilt event. Once the tilt event is sensed, the tilt module can indicate to a user of the external chest compressor, via sound and/or a visual indication, that the tilt event having a predetermined value has been sensed. The indication can prompt the user to check for proper positioning of the external chest compressor on the patient.

These and other features and advantages of this description will become more readily apparent from the following Detailed Description, which proceeds with reference to the drawings, in which:

DETAILED DESCRIPTION

As has been mentioned, the present description is about Cardiopulmonary Resuscitation (CPR) chest compression machines. Embodiments are now described in more detail.

Cardiopulmonary Resuscitation (CPR) Scene

Figure 1:
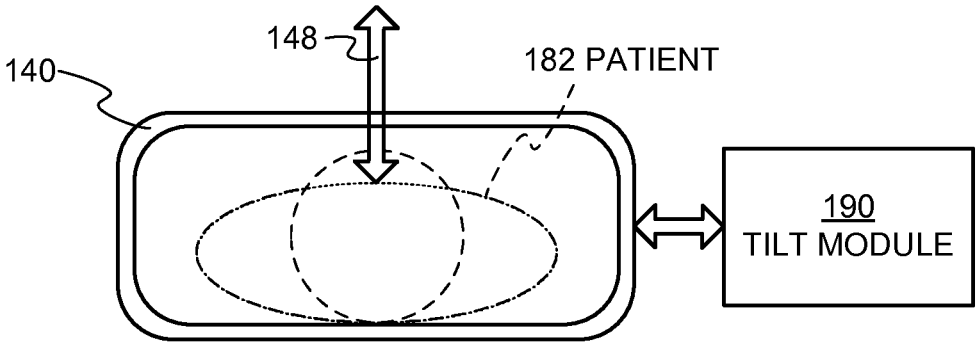
FIG. 1 is a diagram of an abstracted compression structure of a Cardiopulmonary Resuscitation (CPR) chest compression structure used to save the life of a person according to embodiments.

FIG. 1 is a diagram of an abstracted example compression structure 140 of a CPR chest compression structure according to embodiments. A patient 182 is placed within compression structure 140. Then compression structure 140 repeatedly compresses and releases patient 182's chest. These compressions and releases are designated by arrow 148, regardless of how effectuated. Note that the arrow 148 indicates that the compressions are in the center of the patient 182's chest in this embodiment.

Compression structure 140 is shown as reaching around the chest of patient 182. This structure alleviates a problem of the patient being on a flexible mattress, which can result in ineffective CPR. Indeed, compressions 148 are with respect to compression structure 140, not the mattress. But compression structure 140 typically does not cover, for example, the head of patient 182.

The compression structure 140 is coupled to a tilt module 190. The tilt module 190 senses a tilt event of the compression structure 140 and in various embodiments causes the compression structure 140 and/or tilt module 190 to respond to the sensed tilt event. For example, in one embodiment once the tilt event is sensed, the tilt module 190 in various embodiments can indicate to a user of the compression structure 140, via sound and/or a visual indication, that the tilt event having a predetermined value has been sensed. The predetermined value is an angle in some embodiments. In other embodiments, the predetermined value includes a time duration component so that a momentary change in angle does not result in a tilt event being sensed. In various other embodiments, once the tilt event is sensed, the tilt module 190 causes the compression structure 140 to indicate to a user of the compression structure 140, via sound, vibration and/or a visual indication, that a tilt event having a predetermined value has been sensed. The indication can prompt the user to check for proper positioning of the compression structure 140 on the patient. If the positioning is improper, the user can reposition the CPR chest compression structure.

Compression structure 140 is abstracted, in that it may be implemented in any number of ways. In some embodiments, a belt squeezes and releases the patient's chest. In other embodiments, the compression structure is similar to that used in LUCAS™ chest compression systems, available from Jolife AS, Lund, Sweden. A piston embodiment is now described.

Figure 2:
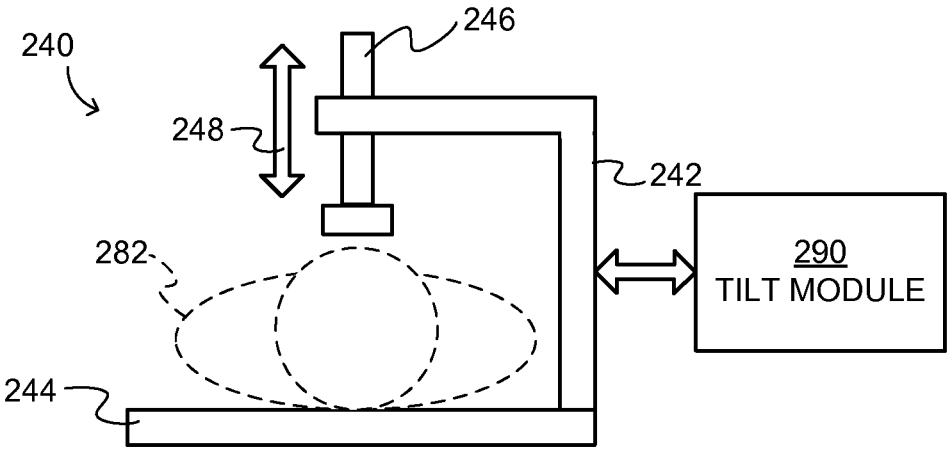
FIG. 2 is a diagram of a sample compression structure of a CPR chest compression structure used to save the life of a person according to embodiments.

FIG. 2 is a diagram of a sample compression structure 240 of a CPR chest compression structure according to embodiments. Structure 240 includes a member 242. A backboard 244 is attached to member 242. Patient 282 is placed on backboard 244. In this embodiment, member 242 partially reaches around patient 282; however, in other embodiments member 242 reaches completely around patient 282 in a manner similar to that of compression structure 140 (FIG. 1). A piston 246 is attached to member 242. Piston 246 is automatically moved up and down, to deliver compressions and releases 248. Note that the arrow 248 indicates that the compressions are in the center of the patient 282's chest in this embodiment.

The compression structure 240 is coupled to a tilt module 290. The tilt module 290 senses a tilt event of the compression structure 240 and in various embodiments causes the compression structure 240 and/or tilt module 290 to respond to the sensed tilt event. For example, in one embodiment once the tilt event is sensed, the tilt module 290 can indicate to a user of the compression structure 240, via sound and/or a visual indication, that the tilt event having a predetermined value has been sensed. The indication can prompt the user to check for proper positioning of the compression structure 240 with respect to the patient.

Figure 3:
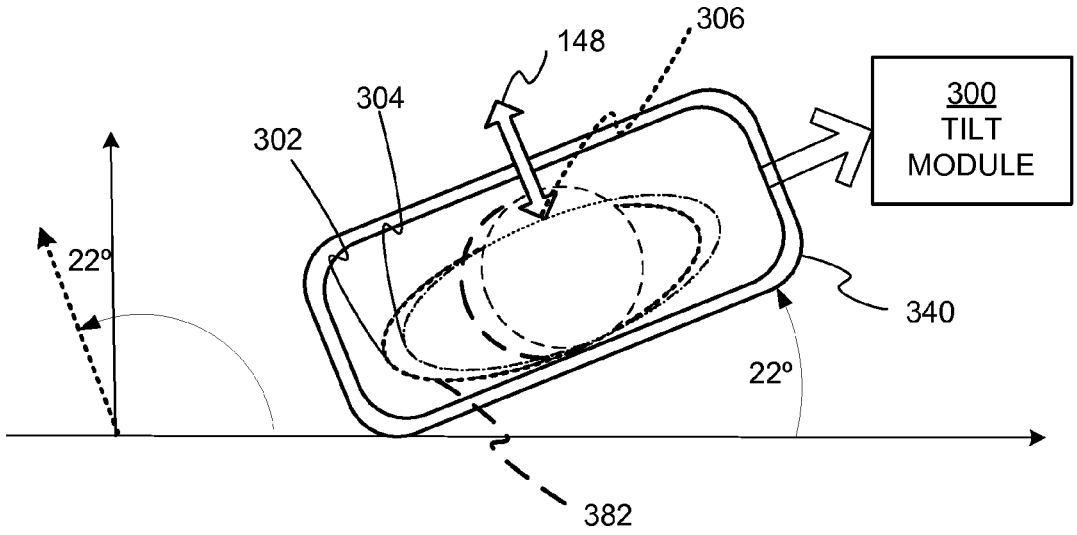
FIG. 3 is a diagram of a tilted CPR chest compression structure according to embodiments.

FIG. 3 is a diagram of the compression structure 340 along with a tilt module 300 according to embodiments. In the illustrated embodiment, the compression structure 340 is tilted twenty-two degrees such that the position of a patient 382 has slid/shifted in the compression structure 340 from a position 302 to a position 304. As a result, the location of the compressions 348 has moved from a location 306, which is at the center of the patient 382's chest in this embodiment to a different position on the patient's chest (now being off-center).

In one or more implementations, the tilt module 300 senses the tilt event. The tilt module 300 in various embodiments causes the CPR chest compression structure 340 and/or the tilt module 300, itself, to respond to the sensed tilt event.

For example, in response to the tilt event the tilt module 300 facilitates indicating to a user of the CPR chest compression structure 340 that the tilt event has occurred. Indications can take various forms. For example, indication can be in the form of audible or visual indicators, such as lights, buzzers, alarms, or the like. Indication can be a voice and/or visual prompt that the user is to check for proper positioning of the CPR chest compression machine. Indication can be after a preset time has elapsed from the occurrence of the tilt event.

The response can be facilitating recordation of statistics associated with the tilt event. The statistics can be statistics associated with the tilt event, such as the duration of the tilt event, whether or not there was a change in operating parameters of the CPR chest compression structure 340 in response to a tilt event, and/or a tilt angle for a tilt event. Operating parameters can be forces measured by the CPR chest compression structure 340 during chest compressions, instantaneous positions for the patient, and the like. For example, as the CPR chest compression structure 340 continues to provide the same depth of compression, if the force parameter that is used to achieve the specific depth of compression changes, it could be indicative of the patient shifting within the CPR chest compression structure 340. Recordation of tilt values can be done continuously during all operations of the CPR chest compression machine, regardless of whether or not a threshold/preset/predetermined value has been attained and/or exceeded.

The response can be facilitating pausing operation of the CPR chest compression machine. The tilt module 300 can facilitate indicating to a user of the CPR chest compression structure 340 one or more reasons for pausing the CPR chest compression machine. The response can be determining that a predetermined chest compression depth and/or a predetermined chest recoil percentage, and/or a coincident change to one or more additional operating parameters has been encountered.

The results of the tilt event can be made available for post-tilt event review. Post-tilt event review software, for example, can include display, interpretation, analysis and quantification of tilt event data. The foregoing indications and responses described in conjunction with FIG. 3 can be implemented in various combinations in other embodiments, with each indication and/or response providing its advantage even if combined with other indication(s) and/or response(s).

Figure 4:
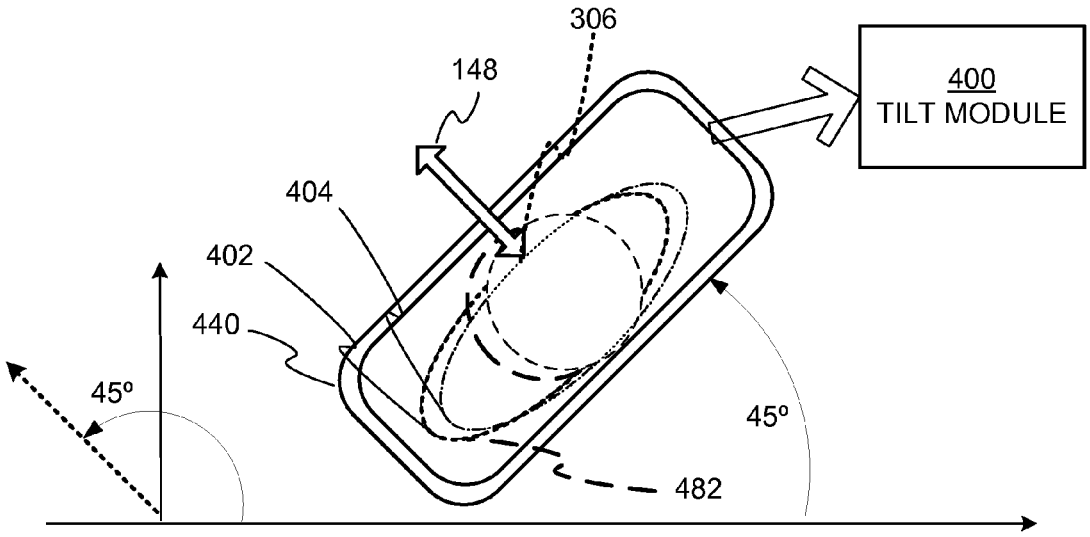
FIG. 4 is a diagram of a tilted CPR chest compression structure according to alternative embodiments.

FIG. 4 is a diagram of the compression structure 440 along with a tilt module 400 according to embodiments. In the illustrated embodiment, the compression structure 440 is tilted forty-five degrees such that the position of a patient 482 has slid/shifted in the compression structure 440 from a position 402 to a position 404. As a result, the location of the compressions 448 has moved from a location 406, which is at the center of the patient 482's chest in this example to a different position on the patient's chest (now being off-center).

In one or more implementations, the tilt module 400 senses the tilt event. The tilt module 400 causes the CPR chest compression structure 440 and/or the tilt module 400, itself, to respond to the sensed tilt event.

For example, in response to the tilt event the tilt module 400 facilitates indicating to a user of the CPR chest compression structure 440 that the tilt event has occurred. Indications can take various forms. For example, indication can be in the form of audible or visual indicators, such as lights, buzzers, alarms, or the like. Indication can be a voice and/or visual prompt that the user is to check for proper positioning of the CPR chest compression machine. Indication can be after a preset threshold time (e.g., five seconds) has elapsed from the occurrence of the tilt event. The preset threshold time can be user-configurable.

In some embodiments, the tilt module 400 may be configured to terminate the indication after a preset time. This set time may be user configurable. In other embodiments, the tilt module 400 may be configured to terminate the indication the earlier of the preset time or in response to detection that the tilt event condition is no longer present. In still other embodiments, the tilt module 400 may be configured to only terminate the indication in response to detection that the tilt event condition is no longer present. In some embodiments, the tilt module 400 may include a switch or other mechanism for a user to manually terminate the indication.

The response can be facilitating recordation of statistics associated with the tilt event. The statistics can be statistics associated with the tilt event, such as the duration of the tilt event, whether or not there was a change in operating parameters of the CPR chest compression structure 440 in response to a tilt event, and/or a tilt angle for a tilt event.

The response can be facilitating pausing operation of the CPR chest compression machine. The tilt module 400 can facilitate indicating to a user of the CPR chest compression structure 440 one or more reasons for pausing the CPR chest compression machine. The response can be determining that a predetermined chest compression depth and/or a predetermined chest recoil percentage, and/or coincident change to one or more additional operating parameters has been encountered.

The results of the tilt event can be made available for post-tilt event review. Post-tilt event review can include display, interpretation, analysis and quantification of tilt event data. The foregoing indications and responses described in conjunction with FIG. 4 can be implemented in various combinations in other embodiments, with each indication and/or response providing its advantage even if combined with other indication(s) and/or response(s)

Example Tilt Event Components

Figure 5:
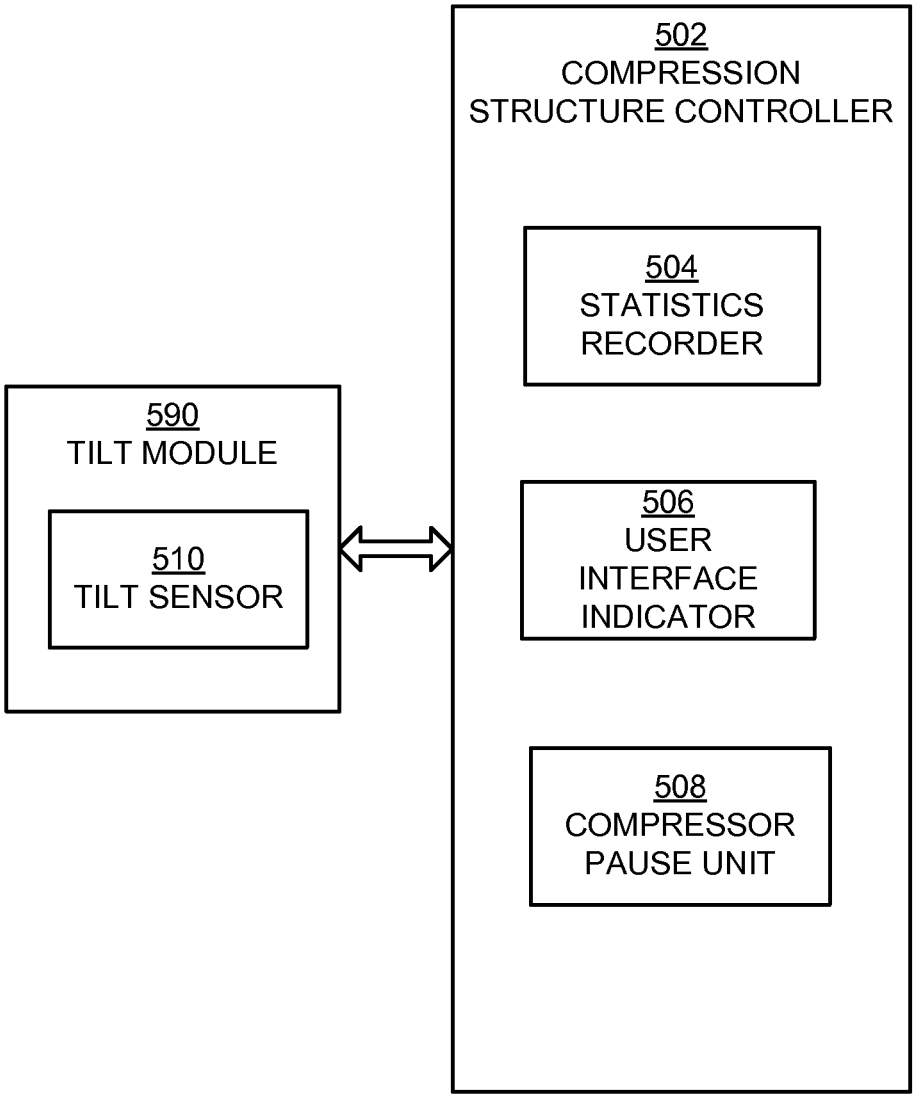
FIG. 5 is a diagram of CPR chest compression structure tilt event components according to embodiments.

FIG. 5 is a diagram of CPR chest compression structure tilt event components for use in a CPR chest compression machine according to embodiments. In the illustrated embodiment, a compression structure controller 502 includes a statistics recorder 504, a user interface indicator 506, and a compressor pause unit 508. A tilt module 590 includes a tilt sensor 510, which senses a tilt event. The tilt module 590 communicates to the compression structure controller 502 that the tilt sensor 510 has sensed a tilt event. Communication among the components can be via any known techniques, such as wireless and/or wired.

The illustrated compression structure controller 502 controls how the CPR chest compression machine responds to one or more responses to tilt events. The controller 502 can be a general purpose controller or a special purpose controller that is programmed to perform the functions described herein.

In one or more implementations, the tilt sensor 510 in the tilt module 590 senses a tilt event for the CPR chest compression machine. The tilt sensor can be an accelerometer, a gyroscope, an inertial measurement unit, or the like that is capable of discriminating and accurately measuring tilt while the CPR chest compression machine is at rest and in motion. The illustrated tilt module 590 in various implementations causes the chest compressor (e.g., compression structure 440 FIG. 4) and/or the tilt module 590 to respond to the tilt event.

The illustrated statistics recorder 504 can be a module within memory of the compression structure controller 502. In one or more implementations, the statistics recorder 504 records statistics pertaining to the CPR chest compression machine. For example, the statistics recorder 504 records inputs from the tilt sensor 510 via the tilt module 590. Statistics can take various forms. For example, in one embodiment statistics can include statistics associated with a tilt event, such as the duration of the tilt event. In other embodiments, statistics can include whether or not there was a change in operating parameters of the CPR chest compression structure in response to a tilt event, and/or a tilt angle for a tilt event.

Responding to the tilt event includes indicating to a user of the CPR chest compression structure that the tilt event has occurred. In one or more implementations, the tilt module 590 notifies the user interface indicator 506 that a tilt event has occurred. This may include notification that the tilt event had an inclination angle larger than a preset angle from the horizontal. For example, in one embodiment the predetermined value can be an incline/tilt angle >45°. The predetermined value can be a user-defined value. In the case that the user-defined value is not met, the tilt event will not be reported to the compression structure controller 502 until the tilt angle reaches or exceeds the preset value. If the preset value is forty-five degrees from the horizontal, then the tilt event illustrated in FIG. 3, which is only twenty-two degrees from the horizontal, will not be reported to the compression structure controller 502 because it is less than the preset value. In other embodiments the predetermined value includes a time duration component that is compared to a minimum duration threshold value so that a momentary change in angle does not result in a tilt event being sensed.

The user interface indicator 506 in one or more implementations includes audible, tactile and visual alerts, such as one or more buzzers, lights, alarms, vibrations, and the like. When a tilt event occurs the tilt event module notifies the user interface indicator 506, which indicates to a user of the CPR chest compression machine, via the buzzers, lights, alarms, vibrations and the like, that the tilt event has occurred. In some embodiments, the indications can also be wirelessly transmitted to a display device such as a tablet device or smartphone device having a corresponding CPR machine app. In some embodiments, the display device can be a defibrillator/monitor such as, for example, LIFEPAK® defibrillator/monitors available from Physio-Control, Inc., Redmond, Wash.

Responding to the tilt event also includes providing data for post-tilt event review. Data may be provided via the user interface indicator 506. The data may be analyzed at a point after the tilt event has occurred.

Responding to the tilt event also includes alerting a user and an automatic reduction in the compression depth.

Responding to the tilt event also includes pausing the operation of the CPR chest compression machine. The compressor pause unit 508 can be utilized for this purpose. For example, the compressor pause unit 508 can pause the chest compressions in response to an ON/OFF switch on the CPR chest compression structure being operated or in response to other conditions known in the art. Alternatively, the compressor pause unit 508 can pause the chest compressions automatically in response to a tilt event and advise the user to check for proper positioning of the CPR chest compression structure before resuming operation.

Responding to the tilt event also includes providing a reason for pausing the operation of the CPR chest compression machine. For example, operation of the CPR chest compression structure can be paused based in part on a determination that a predetermined chest compression depth has been encountered. Operation of the CPR chest compression structure also can be paused can be based in part on a determination that a predetermined chest recoil percentage has been encountered. Operation of the CPR chest compression structure also can be paused can be based in part on a determination that a coincident change to one or more additional operating parameters has been encountered. The compressor pause unit 508 may provide the reason for the pause to the user interface indicator 506, which may display the reason and/or play an audible signal indicating the reason for the paused operation. The foregoing indications and responses described in conjunction with FIG. 5 can be implemented in various combinations in other embodiments, with each indication and/or response providing its advantages even if combined with other indication(s) and/or response(s).

The functions of this description may be implemented by one or more devices that include logic circuitry. The device performs functions and/or methods as are described in this document. The logic circuitry may include a processor that may be programmable for a general purpose, or dedicated, such as microcontroller, a microprocessor, a Digital Signal Processor (DSP), etc. For example, the device may be a digital computer like device, such as a general-purpose computer selectively activated or reconfigured by a computer program stored in the computer. Alternately, the device may be implemented by an Application Specific Integrated Circuit (ASIC), etc.

Moreover, methods are described below. The methods and algorithms presented herein are not necessarily inherently associated with any particular computer or other apparatus. Rather, various general-purpose machines may be used with programs in accordance with the teachings herein, or it may prove more convenient to construct more specialized apparatus to perform the required method steps. The required structure for a variety of these machines will become apparent from this description.

In all cases there should be borne in mind the distinction between methods in this description, and the method of operating a computing machine. This description relates both to methods in general, and also to steps for operating a computer and for processing electrical or other physical signals to generate other desired physical signals.

Programs are additionally included in this description, as are methods of operation of the programs. A program is generally defined as a group of steps leading to a desired result, due to their nature and their sequence. A program is usually advantageously implemented as a program for a computing machine, such as a general-purpose computer, a special purpose computer, a microprocessor, etc.

Storage media are additionally included in this description. Such media, individually or in combination with others, have stored thereon instructions of a program made according to embodiments of the invention. A storage medium according to embodiments of the invention is a computer-readable medium, such as a memory, and is read by the computing machine mentioned above.

Performing the steps or instructions of a program requires physical manipulations of physical quantities. Usually, though not necessarily, these quantities may be transferred, combined, compared, and otherwise manipulated or processed according to the instructions, and they may also be stored in a computer-readable medium. These quantities include, for example electrical, magnetic, and electromagnetic signals, and also states of matter that can be queried by such signals. It is convenient at times, principally for reasons of common usage, to refer to these quantities as bits, data bits, samples, values, symbols, characters, images, terms, numbers, or the like. It should be borne in mind, however, that all of these and similar terms are associated with the appropriate physical quantities, and that these terms are merely convenient labels applied to these physical quantities, individually or in groups.

This detailed description is presented largely in terms of flowcharts, display images, algorithms, and symbolic representations of operations of data bits within at least one computer readable medium, such as a memory. Indeed, such descriptions and representations are the type of convenient labels used by those skilled in programming and/or the data processing arts to effectively convey the substance of their work to others skilled in the art. A person skilled in the art of programming may use these descriptions to readily generate specific instructions for implementing a program according to embodiments of the invention.

Often, for the sake of convenience only, it is preferred to implement and describe a program as various interconnected distinct software modules or features, individually and collectively also known as software. This is not necessary, however, and there may be cases where modules are equivalently aggregated into a single program with unclear boundaries. In any event, the software modules or features of this description may be implemented by themselves, or in combination with others. Even though it is said that the program may be stored in a computer-readable medium, it should be clear to a person skilled in the art that it need not be a single memory, or even a single machine. Various portions, modules or features of it may reside in separate memories, or even separate machines. The separate machines may be connected directly, or through a network, such as a local access network (LAN), or a global network, such as the Internet.

It will be appreciated that some of these methods may include software steps that may be performed by different modules of an overall software architecture. For example, data forwarding in a router may be performed in a data plane, which consults a local routing table. Collection of performance data may also be performed in a data plane. The performance data may be processed in a control plane, which accordingly may update the local routing table, in addition to neighboring ones. A person skilled in the art will discern which step is best performed in which plane.

An economy is achieved in the present document in that a single set of flowcharts is used to describe both programs, and also methods. So, while flowcharts are described in terms of boxes, they can mean both method and programs.

For this description, the methods may be implemented by machine operations. In other words, embodiments of programs are made such that they perform methods in accordance to embodiments of the invention that are described in this document. These may be optionally performed in conjunction with one or more human operators performing some, but not all of them. As per the above, the users need not be collocated with each other, but each only with a machine that houses a portion of the program. Alternately, some of these machines may operate automatically, without users and/or independently from each other.

Example Methods

Figure 6:
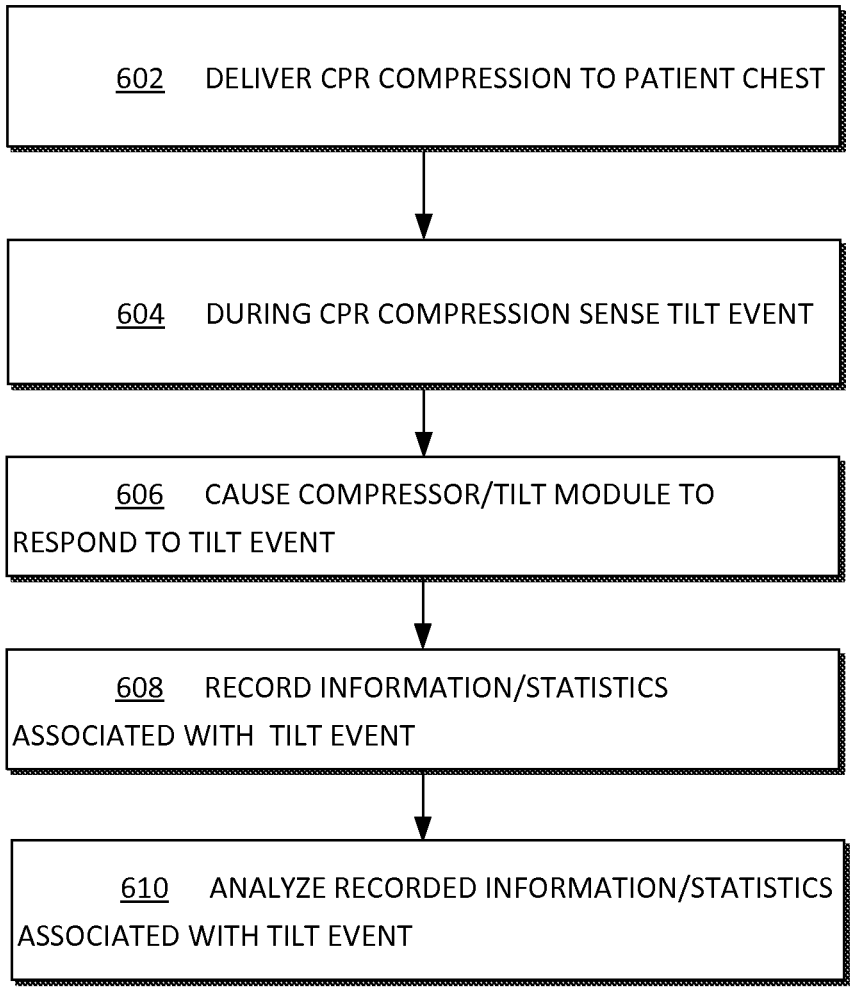
FIG. 6 is a flowchart for illustrating methods according to embodiments.

FIG. 6 shows a flowchart 600 for describing methods according to embodiments, for a CPR chest compression structure to deliver CPR compressions to a patient. The method of flowchart 600 may also be practiced by CPR chest compression machines made according to embodiments described above.

According to an operation 602, chest compressions are delivered to a patient using an external CPR chest compressor.

According to an operation 604, a tilt event is sensed for the chest compressor.

An operation 606 causes the CPR chest compressor and/or a tilt module in the CPR chest compressor machine to respond to the tilt event.

An operation 608 records information/statistics associated with the tilt event.

An operation 610 analyzes the recorded information/statistics associated with the tilt event.

For flowchart 600, it will be recognized that a number of their operations can be augmented with what was described above.

Notes And Additional/Alternative Implementation Details

In the above description of exemplary implementations, for purposes of explanation, specific numbers, materials configurations, and other details are set forth in order to better explain the present invention, as claimed. However, it will be apparent to one skilled in the art that the claimed invention may be practiced using different details than the exemplary ones described herein. In other instances, well-known features are omitted or simplified to clarify the description of the exemplary implementations.

The inventor intends the described exemplary implementations to be primarily examples. The inventor does not intend these exemplary implementations to limit the scope of the appended claims. Rather, the inventor has contemplated that the claimed invention might also be embodied and implemented in other ways, in conjunction with other present or future technologies.

Moreover, the word "exemplary" is used herein to mean serving as an example, instance, or illustration. Any aspect or design described herein as exemplary is not necessarily to be construed as preferred or advantageous over other aspects or designs. Rather, use of the word "exemplary" is intended to present concepts and techniques in a concrete fashion. The term "technology," for instance, may refer to one or more devices, apparatuses, systems, methods, articles of manufacture, and/or computer-readable instructions as indicated by the context described herein.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

Note that the order in which the processes are described is not intended to be construed as a limitation, and any number of the described process blocks can be combined in any order to implement the processes or an alternate process. Additionally, individual blocks may be deleted from the processes without departing from the spirit and scope of the subject matter described herein.

One or more embodiments described herein may be implemented fully or partially in software and/or firmware. This software and/or firmware may take the form of instructions contained in or on a non-transitory computer-readable storage medium. Those instructions may then be read and executed by one or more processors to enable performance of the operations described herein. The instructions may be in any suitable form, such as but not limited to source code, compiled code, interpreted code, executable code, static code, dynamic code, and the like. Such a computer-readable medium may include any tangible non-transitory medium for storing information in a form readable by one or more computers, such as but not limited to read only memory (ROM); random access memory (RAM); magnetic disk storage media; optical storage media; a flash memory, etc.

The term "computer-readable media" includes computer-storage media. For example, computer-storage media may include, but are not limited to, magnetic storage devices (e.g., hard disk, floppy disk, and magnetic strips), optical disks (e.g., compact disk [CD] and digital versatile disk [DVD]), smart cards, flash memory devices (e.g., thumb drive, stick, key drive, and SD cards), and volatile and nonvolatile memory (e.g., RAM and ROM).

In the claims appended herein, the inventor invokes 35 U.S.C. §112, paragraph 6 only when the words "means for" or "steps for" are used in the claim. If such words are not used in a claim, then the inventor does not intend for the claim to be construed to cover the corresponding structure, material, or acts described herein (and equivalents thereof) in accordance with 35 U.S.C. §112, paragraph 6.

What is claimed is:

1. A medical device configured to deliver cardiopulmonary resuscitation (CPR) to a patient, the medical device comprising:

an external chest compressor configured to deliver CPR compressions to a chest of the patient, the external chest compressor including a backboard portion configured to pass underneath the patient; and a tilt module configured to:

sense a tilt event of the backboard portion of the external chest compressor; and cause the external chest compressor or the tilt module or both to respond to the sensed tilt event.

2. A medical device in accordance with claim 1, wherein, in response to the sensed tilt event, the tilt module is further configured to cause an indication to be provided.

3. A medical device in accordance with claim 1, wherein, in response to the sensed tilt event, the tilt module is further configured to cause a wireless transmission of an indication to a display device.

4. A medical device in accordance with claim 1, wherein, in response to the sensed tilt event, the medical device is further configured to record statistics associated with the sensed tilt event.

5. A medical device in accordance with claim 1, wherein, in response to the sensed tilt event, the medical device is further configured to record statistics associated with the sensed tilt event wherein, the statistics include at least one of duration of the tilt event, change in at least one operating parameter of the external chest compressor in response to the tilt event, or tilt angle for the tilt event.

6. A medical device in accordance with claim 1, wherein, in response to the sensed tilt event, the tilt module is further configured to signal the external chest compressor to pause operation.

7. A medical device in accordance with claim 1, wherein, in response to the sensed tilt event, the tilt module is further configured to cause an indication that the tilt event having a predetermined value has been sensed.

8. A medical device in accordance with claim 1, wherein, in response to the sensed tilt event, the tilt module is further configured to cause an indication to be provided, via at least one of a buzzer, a light, or an alarm, that the tilt event having a predetermined value has been sensed, wherein the predetermined value is an inclination by an angle larger than a preset angle from the horizontal.

9. A medical device in accordance with claim 1, wherein, in response to the sensed tilt event, the tilt module is further configured to cause an indication that the tilt event having a user-defined predetermined value has been sensed.

10. A medical device in accordance with claim 1, wherein, in response to the sensed tilt event, the tilt module is further configured to cause an indication to be provided, via at least one of a buzzer, a light, or an alarm, that the tilt event having a user-defined predetermined value has been sensed.

11. A medical device in accordance with claim 1, wherein, in response to the sensed tilt event, the tilt module is further configured to cause an indication that the tilt event has been sensed and that the user is to check for proper positioning of the external chest compressor of the patient.

12. A medical device in accordance with claim 1, wherein, in response to the sensed tilt event, the tilt module is further configured to cause an indication, via at least one of a buzzer, a light, or an alarm, that the tilt event has been sensed and that a user is to check for proper positioning of the external chest compressor on the patient.

13. A medical device in accordance with claim 1, wherein, in response to the sensed tilt event, the tilt module is further configured to signal the external chest compressor to pause operation and to cause an indication to be provided indicative of a reason for the paused operation.

14. A medical device in accordance with claim 1, wherein, in response to the sensed tilt event, the tilt module is further configured to signal the external chest compressor to pause operation in response to:

determining that at least one of a predetermined chest compression depth, a predetermined chest recoil percentage, or a coincident change in one or more operating parameters has been encountered.

15. A medical device in accordance with claim 1, wherein the tilt module includes at least one of an accelerometer, a gyroscope, or inertial measurement unit.

16. A medical device in accordance with claim 1, wherein, in response to the sensed tilt event, the tilt module is further configured to, after a predetermined time has elapsed, cause an indication to be provided that the tilt event has been sensed.

17. A medical device in accordance with claim 1, wherein, in response to the sensed tilt event, the tilt module is further configured to, after a predetermined time has elapsed, cause an indication to be provided, via at least one of a buzzer, a light, or an alarm, that the tilt event has been sensed.

18. A medical device in accordance with claim 1, further comprising an interface that is configured to provide tilt module data for post-tilt-event review.

19. An article comprising: a non-transitory storage medium, the storage medium having instructions stored thereon, wherein when the instructions are executed by at least one medical device configured to deliver cardiopulmonary resuscitation (CPR) to a patient, the at least one medical device including a backboard portion configured to pass underneath the patient, the at least one medical device performs actions comprising:

delivering at least one CPR compression to a chest of the patient using an external chest compressor;

using a tilt module;

sensing a tilt event for the backboard portion of the external chest compressor while performing the at least one CPR compression on the patient; and causing the external chest compressor or the tilt module or both to respond to the tilt event.

20. An article in accordance with claim 19, the actions further comprising:

recording information associated with the tilt event; and facilitating the recorded information to be analyzed.

21. An article in accordance with claim 20, wherein the information includes at least one of a duration of the tilt event, change in at least one operating parameter of the external chest compressor in response to the tilt event, or tilt angle for the tilt event.

22. An article in accordance with claim 19, the actions further comprising, in response to the sensed tilt event, causing an indication.

23. An article in accordance with claim 19, the actions further comprising, in response to the sensed tilt event, indicating, via at least one of a buzzer, a light, or an alarm, that the tilt event has been sensed.

24. An article in accordance with claim 19, the actions further comprising, in response to the sensed tilt event, pausing operation of the external chest compressor.

25. An article in accordance with claim 19, the actions further comprising, in response to the sensed tilt event, causing an indication that the tilt event having a predetermined value has been sensed.

26. An article in accordance with claim 19, the actions further comprising, in response to the sensed tilt event, causing an indication that the tilt event having a user-defined predetermined value has been sensed.

27. An article in accordance with claim 19, the actions further comprising, in response to the sensed tilt event, indicating to a user of the external chest compressor that the tilt event has been sensed and that the user is to check for proper positioning of the external chest compressor on the patient.

28. An article in accordance with claim 19, the actions further comprising, in response to the sensed tilt event, pausing operation of the external chest compressor and causing an indication of a reason for the paused operation.

29. An article in accordance with claim 19, the actions further comprising:

determining that at least one of a predetermined chest compression depth, a predetermined chest recoil percentage, or a coincident change to one or more additional operating parameters has been encountered;

in response to the determining, pausing operation of the external chest compressor; and indicating to a user of the external chest compressor a reason for pausing the operation of the external chest compressor.

30. An article in accordance with claim 19, the actions further comprising, sensing the tilt event for a predetermined duration before causing the external chest compressor or the tilt module or both to respond to the tilt event.

31. An article in accordance with claim 19, the actions further comprising, in response to the sensed tilt even, indicating, after a predetermined time has elapsed, to a user of the external chest compressor that the tilt event has been sensed.

32. A method that facilitates delivery of cardiopulmonary resuscitation (CPR) to a patient by a medical device, the method comprising:

delivering at least one CPR compression to a chest of the patient using an external chest compressor, the external chest compressor including a backboard portion configured to pass underneath the patient;

sensing, by a tilt module, a tilt event for the backboard portion of the external chest compressor while performing the at least one CPR compression on the patient; and causing the external chest compressor or the tilt module or both to respond to the tilt event.

33. A method in accordance with claim 32, further comprising, in response to sensing the tilt event:

recording information associated with the tilt event; and facilitating the recorded information associated with the tilt event to be analyzed.

34. A method in accordance with claim 33, wherein the information includes at least one of duration of the tilt event, change in at least one operating parameter of the external chest compressor in response to the tilt event, or tilt angle for the tilt event.

35. A method in accordance with claim 32, further comprising, in response to the sensed tilt event, indicating that the tilt event has been sensed.

36. A method in accordance with claim 35, further comprising, in response to the sensed tilt event, indicating, via at least one of a buzzer, a light, or an alarm, that the tilt event has been sensed.

37. A method in accordance with claim 32, further comprising, in response to the sensed tilt event, pausing operation of the external chest compressor.

38. A method in accordance with claim 32, further comprising, in response to the sensed tilt event, indicating that the tilt event having a predetermined value has been sensed.

39. A method in accordance with claim 32, further comprising, in response to the sensed tilt event, indicating that the tilt event having a user-defined predetermined value has been sensed.

40. A method in accordance with claim 32, further comprising, in response to the sensed tilt event, indicating to a user of the external chest compressor that the tilt event has been sensed and that the user is to check for proper positioning of the external chest compressor on the patient.

41. A method in accordance with claim 32, further comprising, in response to the sensed tilt event:

pausing operation of the external chest compressor; and indicating a reason for the paused operation.

42. A method in accordance with claim 32, further comprising:

determining that at least one of a predetermined chest compression depth, a predetermined chest recoil percentage, or a coincident change to one or more additional operating parameters has been encountered;

in response to the determining, pausing operation of the external chest compressor; and indicating a reason for pausing the operation of the external chest compressor.

43. A method in accordance with claim 32, wherein the tilt module includes at least one of an accelerometer, gyroscope, or inertial measurement unit.

44. A method in accordance with claim 32, further comprising, in response to the sensed tilt event, indicating, after a predetermined time has elapsed, that the tilt event has been sensed.

45. A method in accordance with claim 32, further comprising, in response to sensing the tilt event:

recording information associated with the tilt event; and facilitating the recorded information associated with the tilt event to be at least one of displayed, interpreted, or quantified.

46. A method that facilitates delivery of cardiopulmonary resuscitation (CPR) to a patient by a medical device, the method comprising:

delivering at least one CPR compression to a chest of the patient using an external chest compressor;

sensing, by a tilt module, a tilt event for the external chest compressor while performing the at least one CPR compression on the patient;

in response to the sensed tilt event, indicating, after a predetermined time has elapsed, that the tilt event has been sensed, wherein the predetermined time is at least five seconds; and causing at least one of the external chest compressor or the tilt module to respond to the tilt event.

* * * * *